US007153415B2

(12) United States Patent
Podrebarac et al.

(10) Patent No.: US 7,153,415 B2
(45) Date of Patent: Dec. 26, 2006

(54) PROCESS FOR THE TREATMENT OF LIGHT NAPHTHA HYDROCARBON STREAMS

(75) Inventors: Gary G. Podrebarac, Houston, TX (US); Willibrord A. Groten, Houston, TX (US); Manoj Som, Houston, TX (US); Martinus J. Almering, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 566 days.

(21) Appl. No.: 10/285,852

(22) Filed: Nov. 1, 2002

(65) Prior Publication Data

US 2004/0000506 A1 Jan. 1, 2004

Related U.S. Application Data

(60) Provisional application No. 60/356,474, filed on Feb. 13, 2002.

(51) Int. Cl.
*C10G 45/00* (2006.01)
*C10G 29/20* (2006.01)

(52) U.S. Cl. ..... 208/211; 208/212; 208/238

(58) Field of Classification Search ..... 208/211, 208/212

See application file for complete search history.

(56) References Cited

U.S. PATENT DOCUMENTS

| | | | | |
|---|---|---|---|---|
| 2,901,417 | A * | 8/1959 | Cook et al. | 208/97 |
| 2,958,654 | A * | 11/1960 | Honeycutt | 208/216 R |
| 3,475,327 | A * | 10/1969 | Eng | 208/211 |
| 3,957,625 | A * | 5/1976 | Orkin | 208/211 |
| 5,906,730 | A | 5/1999 | Hatanaka et al. | 208/210 |
| 6,083,378 | A * | 7/2000 | Gildert et al. | 208/209 |
| 6,126,814 | A | 10/2000 | Lapinski et al. | 208/217 |
| 6,231,753 | B1 | 5/2001 | McKnight et al. | 208/217 |
| 6,303,020 | B1 | 10/2001 | Podrebarac et al. | 208/210 |
| 6,440,299 | B1 | 8/2002 | Hearn et al. | 208/189 |
| 6,444,118 | B1 | 9/2002 | Podrebarac et al. | 208/210 |
| 6,495,030 | B1 | 12/2002 | Podrebarac | 208/218 |
| 2002/0175108 | A1 * | 11/2002 | Debuisschert et al. | 208/57 |

FOREIGN PATENT DOCUMENTS

WO WO 200179391 A1 * 10/2001

* cited by examiner

*Primary Examiner*—Glann Caldarola
*Assistant Examiner*—John Douglas
(74) *Attorney, Agent, or Firm*—Kenneth H. Johnson

(57) ABSTRACT

A light cracked naphtha is treated to convert mercaptans to sulfides and saturate dienes and then subjected to destructive hydrodesulfurization (HDS) to convert the organic sulfur compounds to hydrogen sulfide. The recombinant mercaptans formed by reaction of hydrogen sulfide and olefins at the outlet of the HDS are generally heavier than the light cracked naphtha is fractionated in admixture with a heavy cracked naphtha. A low sulfur content light cracked naphtha is produced as an overheads and the major portion of the mercaptans leave with heavy cracked naphtha as bottoms. It also advantageous to pass the heavy cracked naphtha through the HDS in admixture with the light cracked naphtha, since the recombinant mercaptans formed with the heavy cracked naphtha olefins (which displace some of the lower mercaptans which would form the light cracked naphtha olefins) will be even higher boiling and easier to separate by fractionation.

14 Claims, 2 Drawing Sheets

PROCESS FOR THE TREATMENT OF LIGHT NAPHTHA HYDROCARBON STREAMS

The present application claims the benefit of U.S. Provisional Application 60/356,474, filed Feb. 13, 2002.

BACKGROUND OF THE INVENTION

1. Field of the Invention

The present invention relates generally to a process for removal of sulfur compounds to low levels while minimizing loss of octane. More particularly the invention relates to a process for the removal of mercaptans and thiophenes from a light fluid catalytic cracked naphtha stream.

2. Related Information

Catalytically cracked naphtha gasoline boiling range material currently forms a significant part (≈⅓) of the gasoline product pool in the United States and it provides the largest portion of the sulfur. The sulfur impurities may require removal, usually by hydrotreating, for downstream processing or in order to comply with product specifications or to ensure compliance with environmental regulations.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

(1) $RSH+H_2 \rightarrow RH+H_2S$ (2) $RCl+H_2 \rightarrow RH+HCl$ (3) $2RN+4H_2 \rightarrow RH+NH_3$ (4) $ROOH+2H_2 \rightarrow RH+H_2O$ Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized naphtha.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. for light cracked naphtha (LCN) and a heavy boiling range naphtha which boils in the range of from about 250–475° F. or heavy cracked naphtha (HCN).

The predominant light or lower boiling sulfur compounds are mercaptans while the heavier or higher boiling compounds are thiophenes and other heterocyclic compounds.

Fractionation alone of the LCN will not remove the mercaptans. Often, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

In another process the mercaptans in the light cracked naphtha are reacted directly with the dienes contained within the naphtha to form the disulfides. The disulfides may then be subjected to the standard hydrodesulfurization process. However, in the hydrodesulfurization of naphtha which still contains olefins the $H_2S$ can recombine with olefins at the reactor outlet to produce mercaptans.

It is an advantage of the present invention that the sulfur may be removed from an LCN stream without any substantial loss of olefins.

SUMMARY OF THE INVENTION

Briefly the present invention in its broader view is a process for the removal of organic sulfur compounds comprising mercaptans, preferably recombinant mercaptans, from LCN, which comprises feeding LCN containing, a first amount of organic sulfur compounds comprising mercaptans to a fractionation zone in admixture with a petroleum fraction having a boiling range higher than the boiling range of LCN, such as HCN, and fractionating said admixture under conditions of temperature and pressure to remove a bottoms fraction comprising said petroleum fraction and a portion of the organic sulfur compounds from the LCN and an overheads comprising LCN and a lesser amount of the organic sulfur compounds than that fed to the fractionation zone.

In a more specific embodiment the process comprises: hydrotreating an LCN having a first organic sulfur compound content to convert a portion of said organic sulfur compounds to $H_2S$ and the corresponding olefins and alkanes, removing the $H_2S$, recovering said LCN having second organic sulfur compound content, fractionating said LCN in admixture with an HCN under conditions of temperature and pressure to provide an overheads comprising LCN having a third organic compound sulfur content lower than said second organic compound content and a bottoms comprising HCN.

In a preferred embodiment the process comprises mixing a light cracked naphtha feed having an organic sulfur content with heavy cracked naphtha having a sulfur content to form a mixture contacting the mixture with an HDS catalyst to convert a portion of the sulfur compounds to $H_2S$, removing the $H_2S$ from the mixture and fractionating the mixture under conditions of temperature and pressure to provide a bottoms comprising HCN and preferably returning a portion of said bottoms to mix with said LCN feed and an overheads comprising LCN having lower organic sulfur content than said LCN feed fractionated in the absence of said HCN. In theory in this embodiment the HCN is recycling within loop of the HDS and the fractionation and to remove recombinant mercaptans in the bottoms. In practice the HCN is purged to prevent a buildup of the heavy organic sulfur compounds and other heavy byproducts and makeup HCN is added. The HCN purge may be hydrotreated to reduce sulfur content then returned as makeup.

The LCN feed may previously have been subjected to thioetherification of mercaptans with diolefins to form sulfides and selective hydrogenation of diolefins. Thus, the LCN feed may comprise mercaptans and the sulfides, both of which will react with hydrogen to form $H_2S$ and the corresponding olefins or alkanes. In this step there is also a recombination of olefins (new and original) with the $H_2S$ to produce mercaptans (recombinant mercaptans) which frequently end up in the LCN in prior processes, thus not providing the low sulfur content now required in gasolines.

The HCN provides a higher boiling material that remains two-phase under hydrodesulfurization conditions so that the reactor does not run dry. The presence of HCN also reduces the AT across the reactor. This helps minimize fouling and extends catalyst life. In the distillation column, the recombinant mercaptans, which are often higher boiling than the initial mercaptans, also distill into the HCN, which contributes to the low sulfur content in the LCN product The olefin content of the LCN is not greatly diminished although larger equipment would be required for the same level of LCN throughput without the HCN recycle, which is small cost to pay for cleaner gasoline.

In one embodiment the diolefins in the light cracked naphtha are selectively hydrogenated in a first reactor and then the effluent from the first reactor is combined with heavy cracked naphtha and subjected to destructive hydrodesulfurization in a second reactor to react most of the remaining organic sulfur compound along with the sulfides formed in the first reactor with hydrogen to form $H_2S$, which may be stripped out. The effluent from the second reactor is distilled by fractional distillation in a rerun column where a heavy stream is taken as bottoms, comprising the HCN, which may be returned to the second reactor. The recombinant mercaptans formed at the outlet of the second reactor are generally higher boiling than the light naphtha product and are therefore removed and recycled with the heavy bottoms.

The HCN or petroleum fraction is preferably present with the LCN in a volume ratio of HCN:LCN generally of 4:1 to 1:4, preferably 3:1 to 1:3, and more preferably 1.5:1 to 1:1.5. Equal amounts of LCN and HCN have been found very effective at achieving low sulfur overheads in the fractionation. Thus, in operating the present process, these and other competing factors, are apparent from the description and examples must be considered in finding the optimum set of conditions.

DETAILED DESCRIPTION OF THE INVENTION

Figure 1:
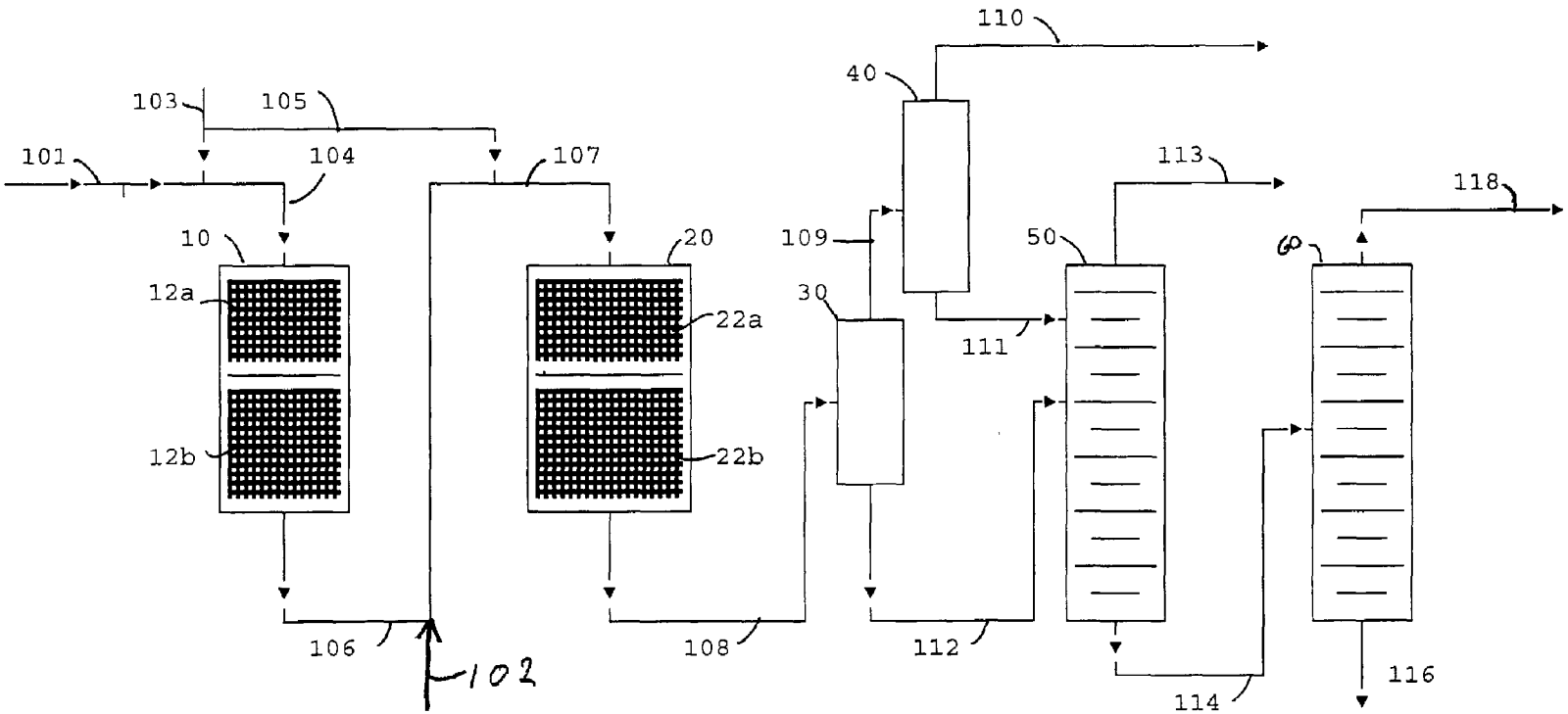
FIG. 1 is a simplified flow diagram of one embodiment of the invention.

The feeds to the process comprise sulfur-containing petroleum fractions which boils in the gasoline boiling range. Feeds of this type include light naphthas having a boiling range of about $C_5$ to 250° F. and heavy range naphthas having a boiling range of 250 to 475° F. Generally the process is useful on the light naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), a-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes, sulfides and disulfides.

The reaction of mercaptans and diolefins to form sulfides is commonly called thioetherification. A catalyst useful for the mercaptan-diolefin reaction is 58 wt. % Ni on 8 to 14 mesh alumina spheres, supplied by Calcicat, designated as E-475-SR. Typical physical and chemical properties of the catalyst as provided by the manufacturer are as follows:

TABLE I

| | |
|---|---|
| Designation | E-475-SR |
| Form | Spheres |
| Nominal size | 8 × 14 Mesh |
| Ni wt. % | 54 |
| Support | Alumina |

The reaction of organic sulfur compounds in a refinery stream with hydrogen over a catalyst to form $H_2S$ is typically called hydrodesulfurization (HDS). Hydrotreating is a broader term which includes saturation of olefins and aromatics and the reaction of organic nitrogen compounds to form ammonia. However hydrodesulfurization is included and is sometimes simply referred to as hydrotreating.

Catalysts which are useful for the hydrodesulfurization reaction contain components from Group V, VIB, VIII metals of the Periodic Table or mixtures thereof. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are converted to the sulfide either in use or prior to use by exposure to sulfur compound containing streams. The catalyst may also catalyze the hydrogenation of the olefins contained within the light cracked naphtha and to a lesser degree the isomerization of some of the mono-olefins. The hydrogenation, especially of the mono-olefins in the lighter fraction may not be desirable.

The properties of a typical hydrodesulfurization catalyst are shown in Table II below.

TABLE II

| | |
|---|---|
| Manufacture | Criterion Catalyst Co. |
| Designation | C-448 |

TABLE II-continued

| | |
|---|---|
| Form | Tri-lobe Extrudate |
| Nominal size | 1.2 mm diameter |
| Metal, Wt. % | |
| Cobalt | 2–5% |
| Molybdenum | 5–20% |
| Support | Alumina |

The catalyst typically is in the form of extrudates having a diameter of 1/8, 1/16 or 1/32 inches and an L/D of 1.5 to 10. The catalyst also may be in the form of spheres having the same diameters. They may be directly loaded into the single pass fixed bed reactor which includes supports and reactant distribution structures.

Reaction conditions for sulfur removal only in a standard single pass fixed bed reactor are in the range of 500–700° F. at pressures of between 400–1000 psig. Residence times expressed as liquid hourly space velocity are generally typically between 1.0 and 10. The naphtha in the single pass fixed bed reaction may be in the liquid phase or gaseous phase depending on the temperature and pressure, with total pressure and hydrogen gas rate adjusted to attain hydrogen partial pressures in the 100–700 psia range. The operation of the single pass fixed bed hydrodesulfurization is otherwise well known in the art. These reactions are very effective and may be operated to convert substantially all of the organic sulfur compounds to $H_2S$ and the corresponding olefins (some corresponding alkanes are also produced). However, the recovered streams, will still contain some mercaptans, regardless of the severity of the HDS conditions (note more sever conditions will result in the hydrogenation of olefins and the corresponding loss of octane), which have been found to result from the reversible reaction of $H_2S$ with available olefins.

As described above, by mixing the HCN with the LCN for the HDS, results in a greater variety of olefins being available for the recombination, particularly higher boiling olefins, which produce mercaptans of higher boiling point, i.e., well above the end point of the LCN fraction. Hence, the benefit of the HCN in the process can be at least twofold depending on its entry in the present process. Even if the HCN is added only to the fractionation, the presence of the substantial amount of heavier components improves and facilitates the removal of the higher boiling mercaptans from olefins of the LCN, for example:

| Species | Normal Boiling Point |
|---|---|
| 1-hexene | 336.6 Kelvin |
| 1-hexanethiol | 424.0 Kelvin |
| 2-hexanethiol | 415.0 Kelvin |
| 1-heptene | 366.8 Kelvin |
| 1-heptanethiol | 450.0 Kelvin |
| 2-heptanethiol | 409.8 Kelvin |

Referring now to FIG. 1 one embodiment of the invention is shown. The light cracked naphtha in flow line 101 is combined with hydrogen from flow line 103 and fed to a hydrogenation reactor 10 containing beds 12*a* and 12*b* of selective hydrogenation catalyst where the mercaptans in the light cracked naphtha are converted to $H_2S$ (and the corresponding olefins) and the diolefins are saturated. The effluent from the hydrogenation and the HCN from flow line 102 in flow line 106/107 is combined with hydrogen from flow line 105 and fed to hydrodesulfurization reactor 20 containing beds 22*a* and 22*b* of hydrodesulfurization catalysts where the thiophenes and other sulfur species are reacted with hydrogen to form hydrogen sulfide. At the same time a portion of the hydrogen sulfide reacts with olefins in the light cracked naphtha to form recombinant mercaptans which generally are higher boiling than the light cracked naphtha.

The effluent from the hydrodesulfurization reactor is fed via flow line 108 to a high pressure separator 30 where the hydrogen and most of the hydrogen sulfide are flashed overheads with the liquid taken via flow line 112. The overheads are then cooled and sent to secondary separator 40 where the hydrogen and hydrogen sulfide are removed. The vapors in flow line 110 may be scrubbed to remove hydrogen sulfide and the hydrogen recycled. The liquids from the separators in flow lines 111 and 112 are fed to stabilizer column 50 where $C_5$'s and lighter material are taken as overheads via flow line 113. The stabilized product is taken as bottoms via flow line 114 and fed to distillation column 60 where the heavier mercaptans and the HCN are separated from the hydrotreated light naphtha as bottoms in line 116. The hydrotreated light naphtha product is taken as overheads via flow line 118.

The conditions in the hydrodesulfurization reactor may be such that the entire feed is vaporized or is maintained to provide a liquid phase in the hydrodesulfurization. The fixed bed, straight pass liquid phase is preferably operated as a trickle bed.

Figure 2:
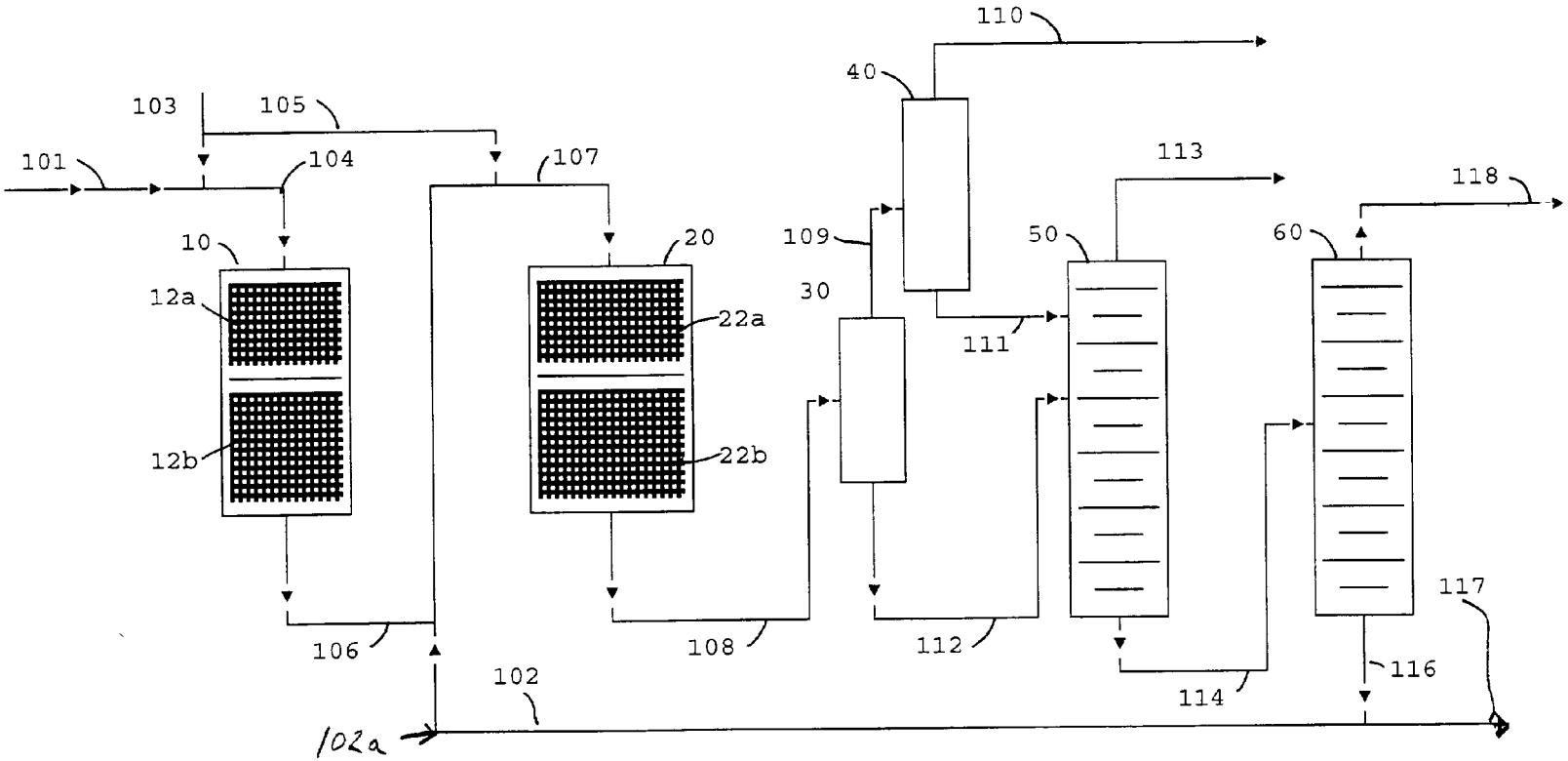
FIG. 2 is a simplified flow diagram of a second embodiment of the invention.

In FIG. 2 as in the FIG. 1 the light cracked naphtha in flow line 101 is combined with hydrogen from flow line 103 and fed to etherification reactor 10 containing beds 12*a* and 12*b* of thioetherification catalyst where the mercaptans in the light cracked naphtha are reacted with diolefins in the light cracked naphtha to form sulfides.

The effluent from the thioetherification reactor in flow line 106 is combined with hydrogen from flow line 105 and the hydrotreated heavy naphtha in flow line 102 and fed to hydrodesulfurization reactor 20 containing beds 22*a* and 22*b* of hydrodesulfurization catalysts where the thiophenes and sulfides are reacted with hydrogen to form hydrogen sulfide. Makeup HCN is added vial line 102*a*. At the same time a portion of the hydrogen sulfide reacts with olefins in the light cracked naphtha to form recombinant mercaptans which generally are higher boiling than the light cracked naphtha.

The effluent from the hydrodesulfurization reactor is fed via flow line 108 to a high pressure separator 30 where the hydrogen and most of the hydrogen sulfide are flashed overheads with the liquid taken via flow line 112. The overheads are then cooled and sent to secondary separator 40 where the hydrogen and hydrogen sulfide are removed. The vapors in flow line 110 may be scrubbed to remove hydrogen sulfide and the hydrogen recycled. The liquids from the separators in flow lines 111 and 112 are fed to stabilizer column 50 where $C_5$'s and lighter material are taken as overheads via flow line 113. The stabilized product is taken as bottoms via flow line 114 and fed to distillation column 60 where the heavier mercaptans and the heavy naphtha are separated from the hydrotreated light naphtha as bottoms in line 116. The hydrotreated light naphtha product is taken as overheads via flow line 118. A portion of the bottoms may be purged via flow line 117 or combined with the light naphtha product (depending on the limitations on sulfur content for the intended market of the product). The remainder of the bottoms is recycled via flow line 102 to the hydrodesulfurization reactor.

EXAMPLE 1

Light cracked naphtha (LCN) and a heavy cracked naphtha (HCN) having the characteristics shown in TABLE III was used as feed to the HDS process (13 lb/hr each). The LCN used had been previously subjected to selective hydrogenation of the dienes in a reactor containing a 20% Ni catalyst at the following conditions: Inlet Temp of 220° F.; Inlet pressure of 231 psig and a 2 WHSV to yield a 90+% diene saturation rate.

The mixture was passed through a fixed bed cocurrent reactor containing a standard hydrodesulfurization catalyst at the following conditions:

Inlet temperature 479° F.;

Inlet pressure 219 psig

WHSV of 6.5.

Following the reaction the $H_2S$ was stripped and removed. The LCN was recovered by distillation and the HCN recycled. The final LCN product had the properties shown in TABLE III.

TABLE III

| | LCN | HCN ASTM D3710, ° F. | LCN PRODUCT |
|---|---|---|---|
| IBP | 137 | 231 | 136 |
| 5% | 141 | 259 | 140 |
| 10% | 143 | 281 | 141 |
| 20% | 150 | 300 | 148 |
| 30% | 161 | 326 | 158 |
| 40% | 175 | 337 | 173 |
| 50% | 186 | 343 | 184 |
| 60% | 196 | 364 | 193 |
| 70% | 205 | 376 | 201 |
| 80% | 220 | 398 | 215 |
| 90% | 235 | 413 | 229 |
| 95% | 240 | 431 | 231 |
| EP | 359 | 455 | 248 |
| Total sulfur | 289 wppm | 12.2 wppm | 1.2 wppm |
| Bromine # | 60 g/100 g | 2.9 g/100 g | 43 g/100 g |
| R Octane | 88.8 | N/A | 85 |
| M Octane | 79.4 | N/A | 78.1 |

As shown by above the distillation curve, the LCN was recovered according expectations from the LCN/HCN mixture. There were a few heavy components in the tail of the LCN which were dropped into the HCN fraction, but there is good agreement between the feed and product boiling points from the initial to the 95% points. The data shows a 99.6 sulfur reduction with only a 28.3% Br# loss, and only an R octane loss of 3.9 and M octane loss of 1.3.

EXAMPLE 2

A second LCN and HCN having the characteristics shown in TABLE IV were used as feed to the process (13 lb/hr each). The LCN had been previously subjected to selective hydrogenation (thioetherification and saturation) of the dienes in a reactor containing a 20% Ni catalyst at the following conditions: Inlet Temp of 235° F.; Inlet pressure of 260 psig and a 2 WHSV to yield a 90+% diene saturation rate.

The mixture was passed through a fixed bed containing a standard hydrodesulfurization catalyst at the following conditions:

| | |
|---|---|
| Inlet temperature, ° F. | 472 |
| Outlet temperature, ° F. | 534 |
| Operating pressure, psig | 250 |
| $H_2$ rate, scf/bbl | 389 |
| WHSV | 6.5. |

Following the reaction the $H_2S$ was stripped and removed. Most of the sulfur was observed to be in the form of mercaptans. The LCN was recovered by distillation and the HCN recycled. The final LCN product had the properties shown in TABLE IV

TABLE IV

| | FEED | | FINAL MXD. | After Distillation | |
|---|---|---|---|---|---|
| | LCN | HCN | PRODUCT | LCN | HCN |
| Total S (mg S/L) | 191 | 17.79 | 10.81 | 6.39 | 18.43 |
| Bromine # | 62.86 | 5.01 | 27.77 | 53.11 | 5.03 |
| Density (g/cc) | 0.7197 | 0.8322 | 0.7728 | 0.7206 | 0.832 |
| Mercaptan (ppm) | 2.4 | 13.3 | 11.8 | 1.5 | 14.5 |
| Boiling Range D3710 | | | | | |
| ibp ° F. | 135 | 237 | 139 | 136 | 237 |
| 5% pt ° F. | 139 | 259 | 147 | 140 | 259 |
| 10% pt ° F. | 141 | 278 | 158 | 146 | 278 |
| 20% pt ° F. | 148 | 285 | 178 | 156 | 285 |
| 30% pt ° F. | 159 | 319 | 198 | 168 | 319 |
| 40% pt ° F. | 172 | 329 | 218 | 182 | 329 |
| 50% pt ° F. | 183 | 341 | 242 | 190 | 341 |
| 60% pt ° F. | 193 | 355 | 282 | 195 | 355 |
| 70% pt ° F. | 204 | 374 | 326 | 206 | 374 |
| 80% pt ° F. | 218 | 396 | 352 | 219 | 396 |
| 90% pt ° F. | 229 | 413 | 394 | 229 | 413 |
| 95% pt ° F. | 235 | 432 | 411 | 230 | 432 |
| fbp ° F. | 357 | 458 | 449 | 247 | 459 |
| Amount of LCN (lb/h) | 13 | | | | |
| Amount of HCN (lb/h) | 13 | | | | |

In the distillation, the mercaptans tend to distill downward, and out of the final product, leaving very low residual S in the finished LCN. The mercaptans are then recycled back to the HDS reactor where they are reconverted to $H_2S$.

The invention claimed is:

1. A process for the removal of organic sulfur compounds while minimizing loss of octane comprising mercaptans from LCN, which comprises fractionating an admixture consisting of LCN containing a first amount of organic sulfur compounds comprising mercaptans and an HCN in a ratio of HCN:LCN of 4:1 to 1:4 in a fractionation zone in under conditions of temperature and pressure to remove a bottoms fraction comprising said HCN and a portion of the organic sulfur compounds from the LCN and an overheads comprising LCN and a lesser amount of the organic sulfur compounds than that fed to the fractionation zone, whereby the olefin content of the LCN is not greatly diminished.

2. The process according to claim 1 wherein said mercaptans comprise recombinant mercaptans.

3. A process for removal of sulfur compounds to low levels while minimizing loss of octane comprising hydrotreating an LCN having a first organic sulfur compound content to convert a portion of said organic sulfur compounds to $H_2S$ and the corresponding olefins and alkanes, removing the $H_2S$, recovering said LCN having a second organic sulfurcompound content, fractionating said LCN in an admixture consisting of said LCN and an HCN in a ratio of HCN:LCN of 4:1 to 1:4 under conditions of temperature and pressure to provide an overheads comprising LCN having a third organic compound sulfur content lower than said second organic compound content and a bottoms comprising HCN, whereby the olefin content of the LCN is not greatly diminished.

4. The process according to claim 3 wherein said HCN is present in said hydrotreating.

5. In a process for the hydrodesulfurization of a light cracked naphtha stream containing organic sulfur compounds and olefins while minimizing loss of octane comprising passing the light cracked naphtha stream over a bed of hydrodesulfurization catalyst in a hydrodesulfurization reactor to react of a portion of the organic sulfur compounds within the light cracked naphtha stream with hydrogen to form hydrogen sulfide and wherein a portion of the hydrogen sulfide produced reacts with a portion of the olefins to produce recombinant mercaptans, the improvement comprising fractionating an effluent from the reactor consisting of an admixture of said effluent with a heavy cracked naphtha stream in a ratio of HCN:LCN of 4:1 to 1:4 to remove a heavy stream containing the recombinant mercaptans, whereby the olefin content of the LCN is not greatly diminished.

6. The process according to claim 5 wherein said light cracked naphtha stream contains diolefins and mercaptans and is first subjected to selective hydrogenation and thioetherification in a first reactor to react a portion of the diolefins with a portion of the mercaptans to produce sulfides which are further reacted in said hydrodesulfurization reactor with hydrogen to form hydrogen sulfide.

7. The process according to claim 6 wherein said desulfurized heavy naphtha is removed as bottoms when the effluent from the reactor is fractionated to remove the heavy stream containing said recombinant mercaptans.

8. The process according to claim 7 wherein at least of portion of said bottoms is recycled to said hydrodesulfurization reactor.

9. A process for the hydrodesulfurization of a light cracked naphtha stream containing mercaptans, thiophenes, olefins and diolefins while minimizing loss of octane comprising:

(a) feeding said light cracked naphtha stream to a selective hydrogenation/thioetherification reaction zone containing a thioetherification/selective hydrogenation catalyst wherein a portions of said mercaptans react with a portion of said diolefins to form sulfides;

(b) feeding hydrogen, and a feed consisting of the effluent from said selective hydrogenation/thioetherification reaction zone and a heavy cracked naphtha in a ratio of HCN:LCN of 4:1 to 1:4 to a hydrodesulfurization reactor containing a hydrodesulfurization catalyst wherein a portion of said thiophenes and said sulfides are reacted to form hydrogen sulfide and wherein a portion of said hydrogen sulfide reacts with a portion of said olefins to produce recombinant mercaptans which have a higher boiling point than said light cracked naphtha; and (c) feeding the effluent from said hydrodesulfurization reaction zone to a distillation zone wherein said recombinant mercaptans are separated from said light cracked naphtha by fractional distillation in a bottoms, whereby the olefin content of the LCN is not greatly diminished.

10. The process according to claim 9 wherein the conditions within said hydrodesulfurization reaction zone are such that all of said light cracked naphtha stream is in the vapor phase.

11. The process according to claim 10 wherein the conditions within said hydrodesulfurization reaction zone are such that at least a portion of said naphtha is in the liquid phase.

12. The process according to claim 11 wherein said desulfurized heavy naphtha is removed as bottoms from said distillation zone.

13. The process according to claim 12 wherein at least of portion of said bottoms is recycled to said hydrodesulfurization reaction zone.

14. A process for the hydrodesulfurization of a light cracked naphtha stream containing mercaptans, thiophenes, olefins and diolefins while minimizing loss of octane comprising:

(a) feeding said light cracked naphtha stream to a selective hydrogenation/thioetherification reactor containing a selective hydrogenation/thioetherification catalyst wherein a portions of said mercaptans react with a portion of said diolefins to form sulfides;

(b) feeding hydrogen, a mixture consisting of an effluent from said selective hydrogenation/thioetherification reactor and a desulfurized heavy naphtha stream in a ratio of HCN:LCN of 4:1 to 1:4 to a hydrodesulfurization reactor containing a hydrodesulfurization catalyst wherein a portion of said thiophenes and said sulfides are reacted to form hydrogen sulfide and wherein a portion of said hydrogen sulfide reacts with a portion of said olefins to produce recombinant mercaptans which have a higher boiling point that said light cracked naphtha;

(c) feeding the effluent from said hydrodesulfurization reactor to a distillation column wherein said recombinant mercaptans and said desulfurized heavy naphtha are separated as bottoms from said light cracked naphtha by fractional distillation; and (d) recycling at least a portion of said bottoms to said hydrodesulfurization reactor, whereby the olefin content of the LCN is not greatly diminished.

* * * * *

UNITED STATES PATENT AND TRADEMARK OFFICE

CERTIFICATE OF CORRECTION

PATENT NO. : 7,153,415 B2
APPLICATION NO. : 10/285852
DATED : December 26, 2006
INVENTOR(S) : Gary G. Podrebarac et al.

It is certified that error appears in the above-identified patent and that said Letters Patent is hereby corrected as shown below:

In the Claims:

Column 9, lines 6-8, "organic sulfur compounds while minimizing loss of octane comprising mercaptans from LCN," should be --organic sulfur compounds comprising mercaptans from LCN while minimizing loss of octane,--.

Signed and Sealed this

Sixth Day of November, 2007

JON W. DUDAS
*Director of the United States Patent and Trademark Office*